US006164642A

United States Patent [19]

Onipchenko et al.

[11] Patent Number: 6,164,642

[45] Date of Patent: Dec. 26, 2000

[54] BANKNOTE CENTERING DEVICE FOR A VALIDATOR

[75] Inventors: Alexander Onipchenko; Sergey Bukhman; Vladimir A. Schwartz, all of Kiev, Ukraine

[73] Assignee: Cashcode Company Inc., Concord

[21] Appl. No.: 09/152,793

[22] Filed: Sep. 14, 1998

[51] Int. Cl.[7] ..... B65H 9/00; B65H 1/00; B65H 9/04

[52] U.S. Cl. ..... 271/240; 271/171; 271/253; 271/254

[58] Field of Search ..... 271/240, 253, 271/254, 171

[56] References Cited

U.S. PATENT DOCUMENTS

| | | | |
|---|---|---|---|
| 4,667,809 | 5/1987 | Raybuck | 198/456 |
| 4,750,660 | 6/1988 | Kamimura | 226/199 |
| 5,091,754 | 2/1992 | Abe et al. | 399/394 |
| 5,290,027 | 3/1994 | Clanton et al. | 271/227 |
| 5,332,209 | 7/1994 | Romansky et al. | 271/171 |
| 5,368,147 | 11/1994 | Menke et al. | 194/206 |
| 5,547,062 | 8/1996 | Mays et al. | 194/206 |
| 5,749,294 | 5/1998 | Ruf et al. | 101/232 |

*Primary Examiner*—Donald P. Walsh
*Assistant Examiner*—Brett C. Martin

[57] ABSTRACT

A banknote centering device uses a clutch arrangement to limit inward movement of side engaging plates used to center a banknote. The clutch also allows a fixed cycle motor to be used for both inward and outward movement of the side engaging numbers. The resistance of the banknote to buckling in the slot is sufficient to cause the clutch to slip. The device is rugged, easy to produce, and has proven very reliable.

11 Claims, 9 Drawing Sheets

10
2
4
5
6

BANKNOTE CENTERING DEVICE FOR A VALIDATOR

BACKGROUND OF THE INVENTION

The present relates to centering devices for banknotes or paper currency designed to center a banknote for processing by a validator or other like device.

Currency validators have proven to be extremely popular for use with vending machines, banking machines and other devices requiring payment. In some circumstances, the currency validator can be designed to receive a banknote of a given width which is longitudinally fed into the currency validator. In some countries and in particular in many European countries, the currency is not of a fixed width and the widths vary considerably. It is desirable to process banknotes in a similar manner by aligning the center line of the banknote with a common central line of the validator. In this way, the scanning devices are always positively located relative to the center line of the currency.

There have been various structures to achieve this centering aspect. One such design has a slot with a number of stepped regions each centered with respect to the center line. In this way, a currency of a narrow width is located in a narrow slot and larger width currency is appropriately placed in a larger slot. With this structure, the user must properly locate the currency for processing. Another example of a centering arrangement is found U.S. Pat. No. 5,368,147. In this device, the currency is fed longitudinally into the centering device and a spring type action is used between two side engaging members to center the currency about a center line of the validator. This device is quite complicated and is difficult to manufacture and is subject to considerable variations.

It is desirable to be able to provide a centering device which is reliable, accurate and easy to manufacture.

SUMMARY OF THE INVENTION

A banknote centering device according to the present invention comprises an enlarged slot for loosely receiving a banknote longitudinally, with side engaging members associated with the slot and movable from an open position either side of the slot to a narrow end position defining a minimum separation distance between the side engaging members. A banknote drive mechanism is provided for initially driving a banknote received in said slot from an insert position to a centering position where the banknote is freely movable laterally within the slot. A drive arrangement for moving the side engaging members in a controlled manner is provided which moves the side engaging members towards one another and equally spaced either side of the center line of the slot. This drive arrangement includes a clutch for controlled slippage of the drive arrangement when further inward movement of the side engaging members is opposed by the sides of the banknote being parallel therewith and contacting the side engaging members over a substantial length thereof such that the banknote is centered in the slot. In this way, the side engaging members stop when the banknote has been appropriately centered and continued action to drive the side engaging members towards the narrow end position does not occur as the resistance of the banknote supported in the slot causes slippage of the clutch.

With this arrangement, the drive is simplified in that the clutch automatically controls the desired action of the side engaging members and appropriately disconnects the drive arrangement from the side engaging members when the banknote has been centered. This allows bills of different widths to be centered without any predetermined knowledge of the width thereof. Furthermore, when the drive arrangement is reversed and the side engaging members are driven to the open position, continued movement of the motor, which would otherwise cause further separation of the side engaging members, does not occur and the clutch provides the required slippage. In this way, the cycle of the drive arrangement for the side engaging members in most cases is oversized resulting in some slippage when the side engaging members are brought together and also resulting in some slippage when the side engaging members reach their fully open position and the drive arrangement hasn't quite completed its cycle. Thus the clutch provides the appropriate adjustment necessary for bills of different widths.

According to an aspect of the invention, the side engaging members are slidable along a common shaft and the drive arrangement is positioned to one side of this shaft.

According to yet a further aspect of the invention, the drive arrangement includes a pair of screw drive members in drive connection with and paired with one of the side engaging members. The screw drive members are carried on a second shaft parallel to the common shaft and each screw drive member drives the paired side engaging member in sympathy with the screw drive member.

According to yet a further aspect of the invention, the drive arrangement includes a fixed cycle reversible motor connected to the clutch with the clutch rotating the second shaft in one direction causing the side engaging members to move towards each other and in a second direction causing the side engaging members to move to the open position.

BRIEF DESCRIPTION OF THE DRAWINGS

Preferred embodiments of the invention are shown in the drawings wherein.

DETAILED DESCRIPTION ACCORDING TO THE PREFERRED EMBODIMENTS OF THE PRESENT INVENTION

Figure 1:
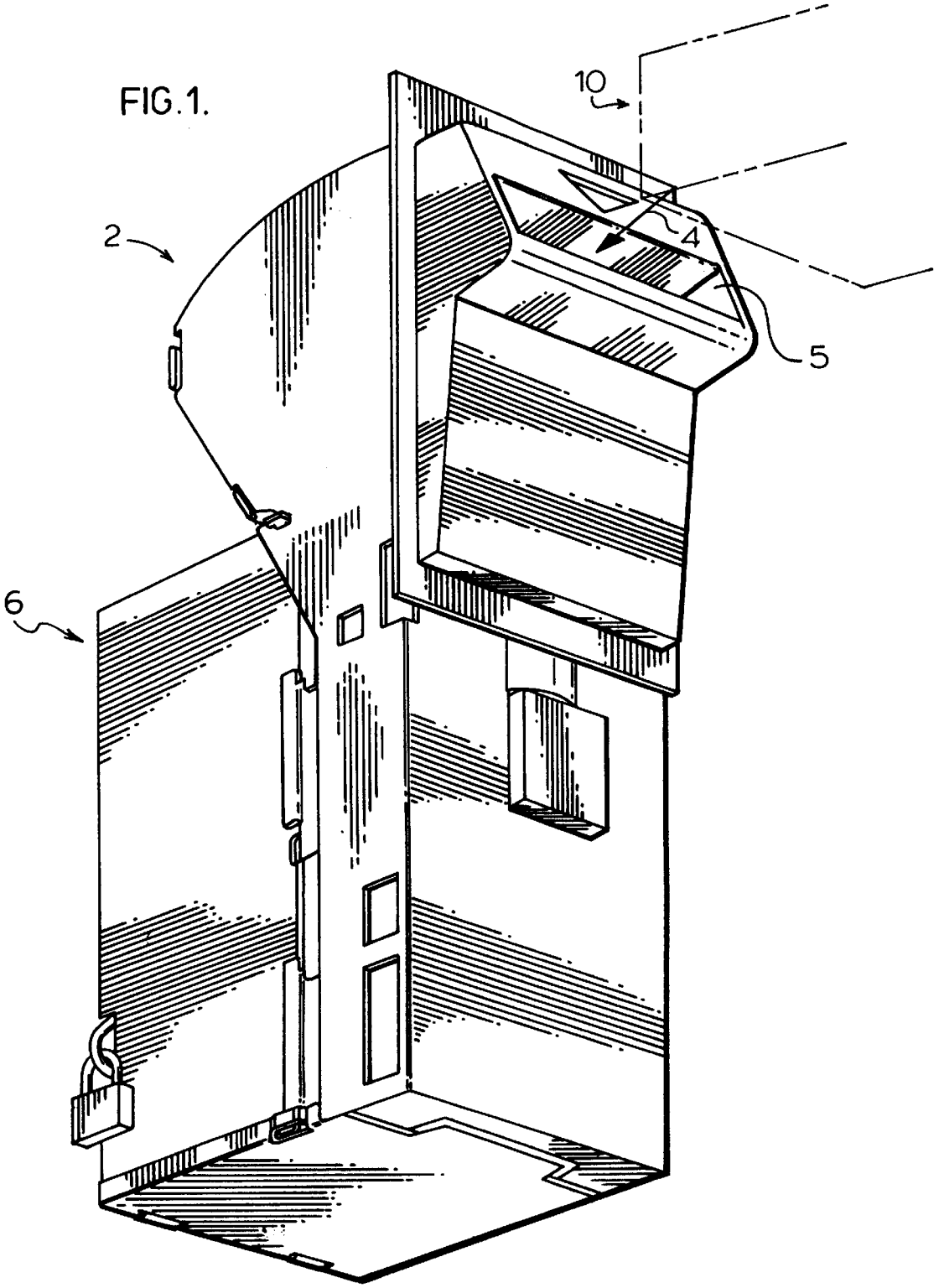
FIG. 1 shows a partial perspective view of a validator with a banknote centering device at the inlet thereof.

The validator 2 shown in FIG. 1 has an inlet slot 4 which receives banknotes as generally indicated by the arrow 5 and appropriately processes the currency. If the currency is determined to be authentic, the currency is then stored in the stacker box 6. There are various designs of banknote validators which use optical and magnetic scanners for determining whether the bill is authentic and the value thereof. In some cases, the banknote is of a more or less fixed width and as such the slot 4 can be sized to provide the required guidance for receiving the bill into the validator. The bill, because of this guidance and the fixed width of the banknote is generally centered and the various tests are carried out. As discussed previously, in some countries, banknotes vary considerably in width and when a validator is to receive and process banknotes of different currencies, they are almost always of different widths. This problem has been previously recognized and a centering device 10 can be either separately associated with the validator 2 as indicated in FIG. 1 or it can be built into the validator.

Figure 2:
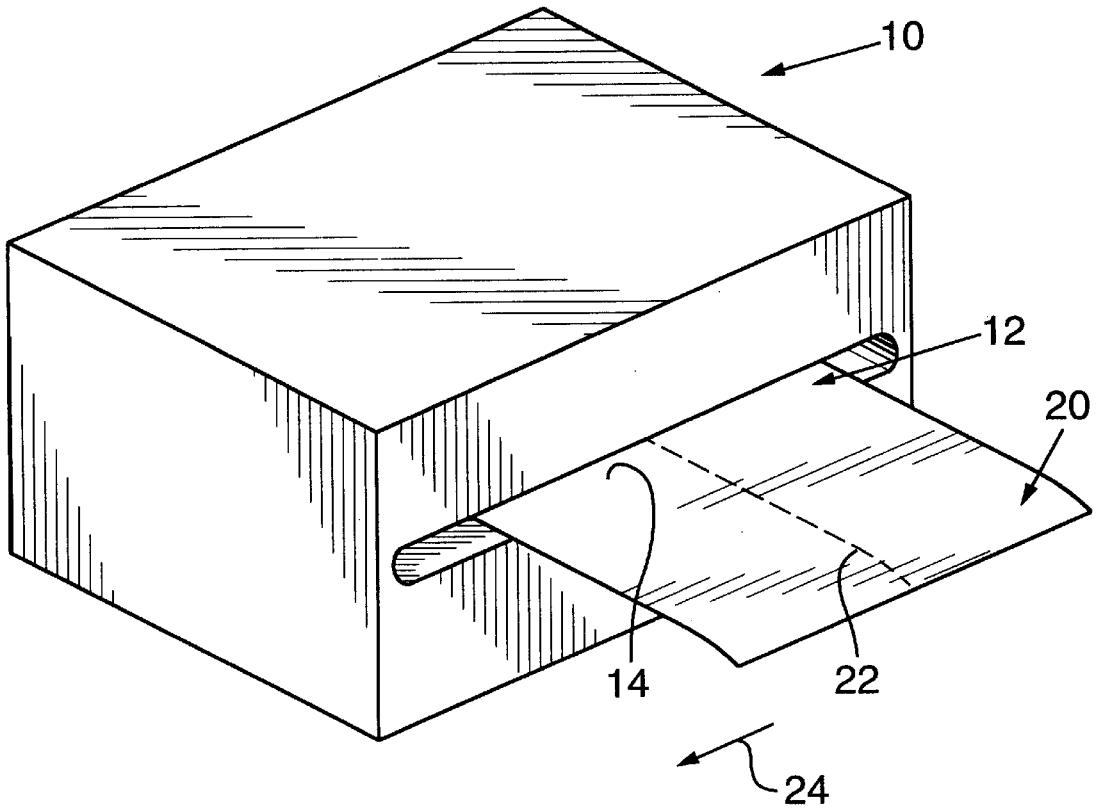
FIG. 2 is an approximate perspective view of the centering device.
Figure 3:
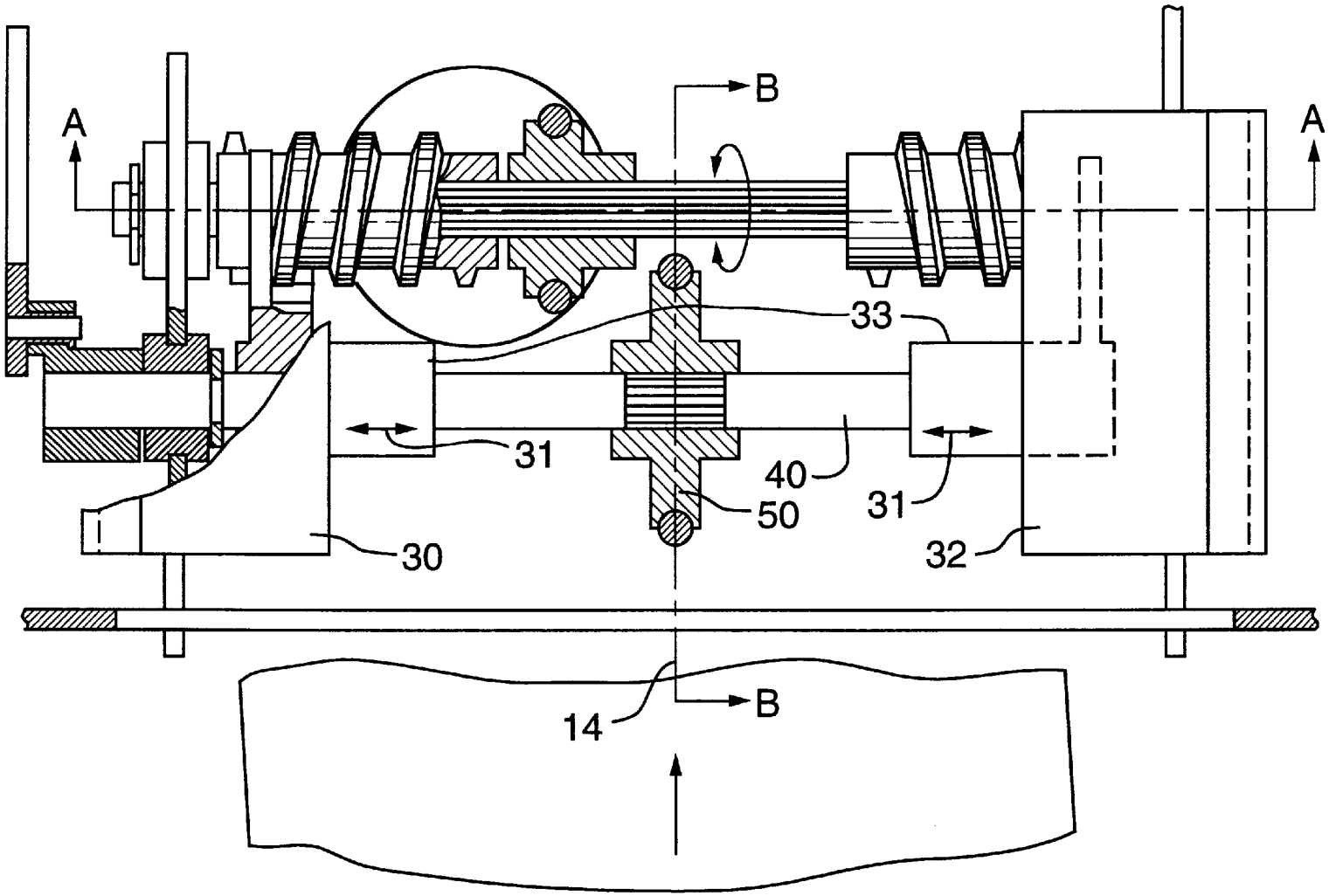
FIG. 3 is a top view showing the drive arrangement for the validator.

Details of the centering device of the present invention are in FIG. 3. The centering device 10, shown in FIG. 2, includes an oversized slot 12 which receives the banknote 20 longitudinally and the center line of the banknote 22 in most cases will not be aligned with the center line of the slot generally indicated as 14. It can also be appreciated that the banknote may be at a slight angle as it longitudinally fed into the center device. The centering device initially drives the banknote into the centering device and then releases the banknote for centering relative to the center line 14. In this case, the banknote will require a direct correction as generally indicated as 24, in FIG. 2.

Figure 4:
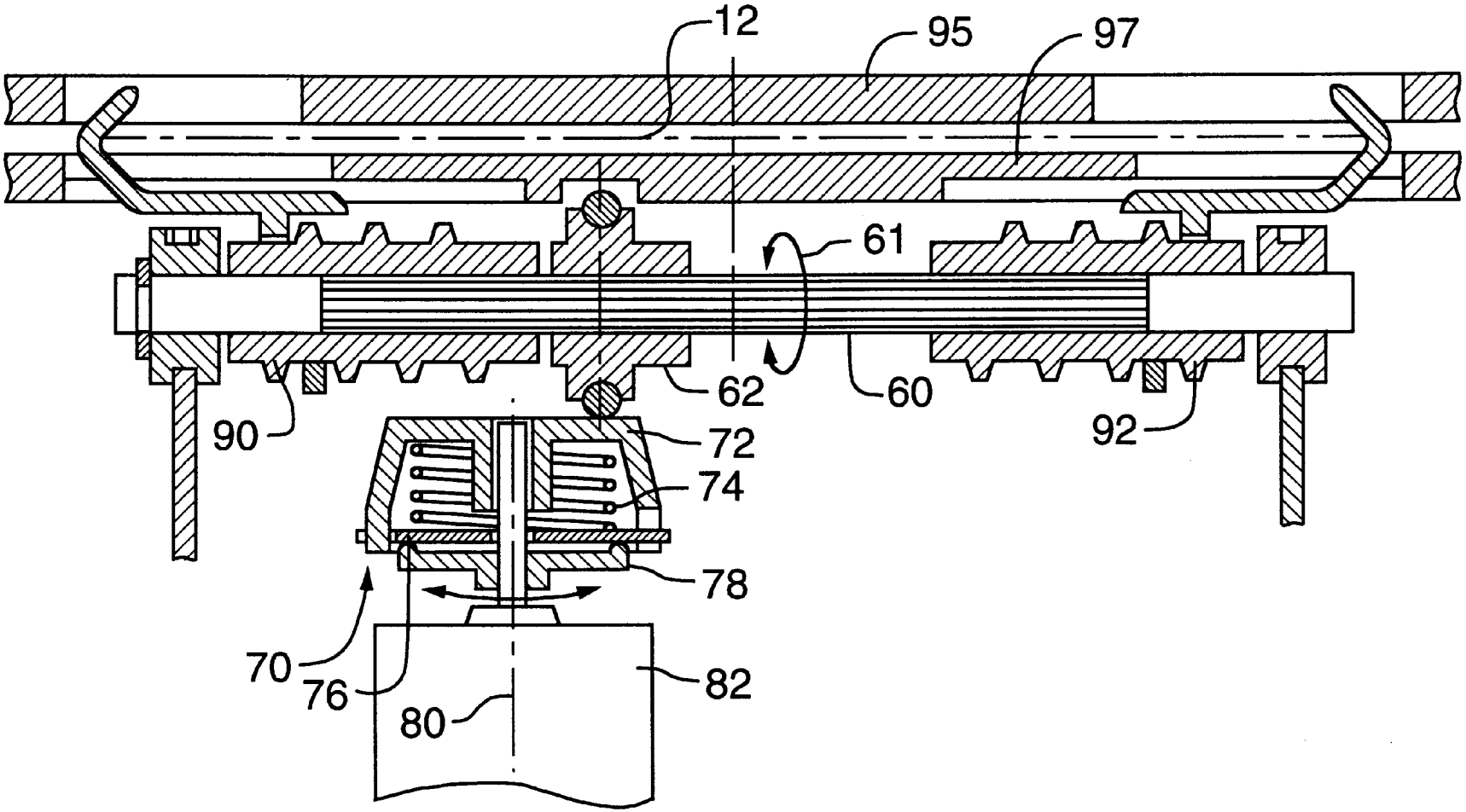
FIG. 4 is a sectional view taken along line A—A of FIG. 3.

The top view of FIG. 3 which shows the details of the centering mechanism illustrate how this centering is accomplished. Side engaging members 30 and 32 are movable from the fully open position of FIG. 3 to a fully closed inner position. The movement of these members is generally shown by the arrow 31. The side members move together and are equally spaced either side of the center line 14. Each of the side engaging members 32 include a bearing portion 33 which freely slides on the first shaft 40. This shaft is a driven shaft and includes the drive wheel 50 which engages the banknote when it is inserted into the slot 12 of the centering device and drives it into the centering device and then releases the banknote for centering. This release will be explained with respect to FIG. 5. Once the banknote has been initially moved into the centering device and released so that it is free to move laterally, a centering operation is initiated. A motor shown as 82 in FIG. 4 has a drive shaft 80 which drives the drive plate 78. This drive plate is in friction contact with the pressure plate 76 of the clutch 70. The spring 74 applies pressure to the drive plate 78 and there is a friction drive arrangement between the drive member 78 and the pressure plate 76.

The opposite side of the clutch includes the rotary cup 72 in drive contact with the drive wheel 62. Drive wheel 62 is splined on the second shaft 60 and causes the rotation thereof generally indicated by the arrow 61. It can be seen that the shaft 60 will rotate in one direction with one direction of rotation of the shaft 80 of the motor 82 and will rotate in the opposite direction with an opposite direction of the motor.

Rotation of shaft 60 also causes rotation of the screw drive members 90 and 92 carried on and secured to the shaft 60. Each screw drive member is associated with one of the side engaging members 30 and 32 and causes controlled movement thereof inwardly from the open position of FIG. 4 to a narrow position as the screw drive causes these members to move inwardly. The opposite direction of rotation of motor 82 will cause these members to move outwardly.

A banknote is received in the slot 12 and is supported either side by the plates 95 and 97. The banknote provides resistance to further inward movement of the side engaging members 30 and 32 during the centering operation. This resistance is sufficient to initially cause movement of the banknote until it is engaged by each side engaging member to align the banknote with the side engaging members and to center it on the center line 14 of the centering device. Once this is accomplished, continued rotation of shaft 80 of the motor does not cause further inward movement of the side engaging members as the clutch 70 slips and therefore the motor continues to go through its cycle but the side engaging members have stopped and centered the banknote. Thus the side engaging members will in most cases be somewhere between their fully opened position and their fully narrow position. The only time they reach the fully narrow position is when this position corresponds with the banknote of that width and such a banknote is placed in the centering device.

Figure 5:
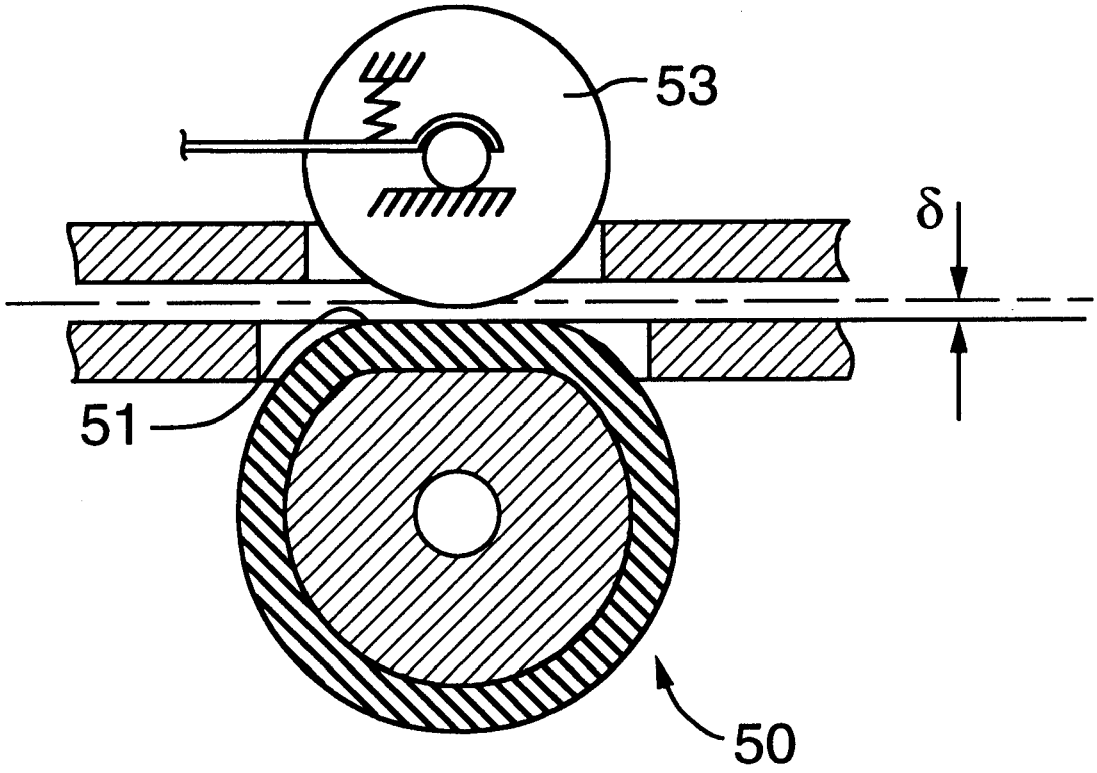
FIG. 5 is a sectional view taken along line B—B of FIG. 3.
Figure 6:
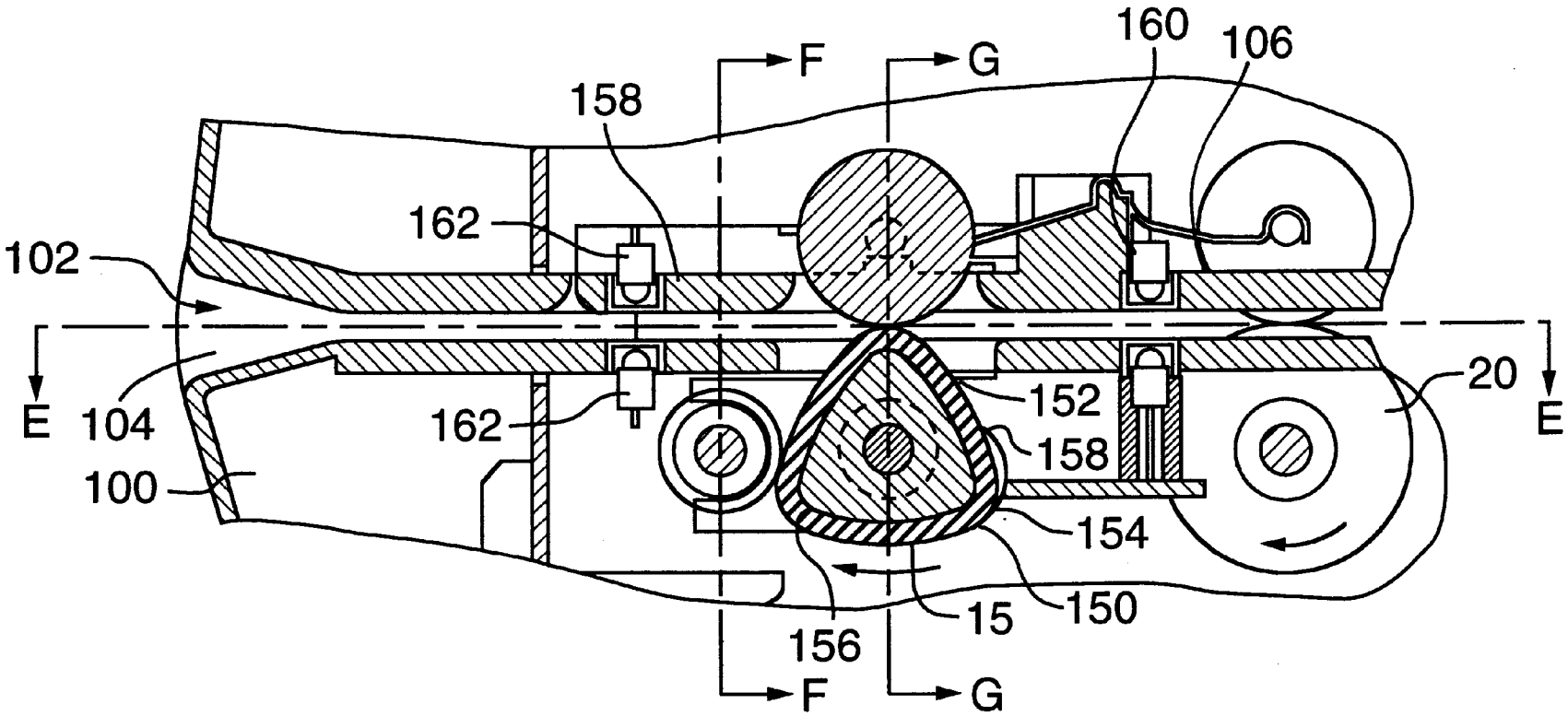
FIG. 6 is a vertical sectional view along the longitudinal axis of an alternate centering arrangement.

FIG. 5 shows how a banknote can be driven into the centering device and subsequently released to float in the slot for carrying out the centering operation. In this case, the bill floats within, and is supported by the slot 12. FIG. 5 illustrates how the drive wheel 50 includes a flattened portion 51 which allows the bill to float. As a banknote enters the centering device, it is initially pulled inwardly until the flat spot is reached at which time it is effectively free to float or move within the bank slot. The flat spot 51 allows separation from the pressure roller 53 as indicated in FIG. 5. Once the banknote has been centered, further rotation of the drive wheel 50 will cause re-engagement of the drive wheel with the banknote and force it against the pressure roller 53 and cause the desired movement of the banknote. This provides a simple mechanism for allowing the banknote to freely float within the slot 12 and allow the centering process to be completed.

The alternate centering device shown in FIGS. 6 through 10, is able to provide the same centering of banknotes of different widths using a different drive mechanism. The banknote centering device 100 has a pathway 102 for moving of banknotes from the inlet 104 to a centered position generally shown as 106.

Figure 8:
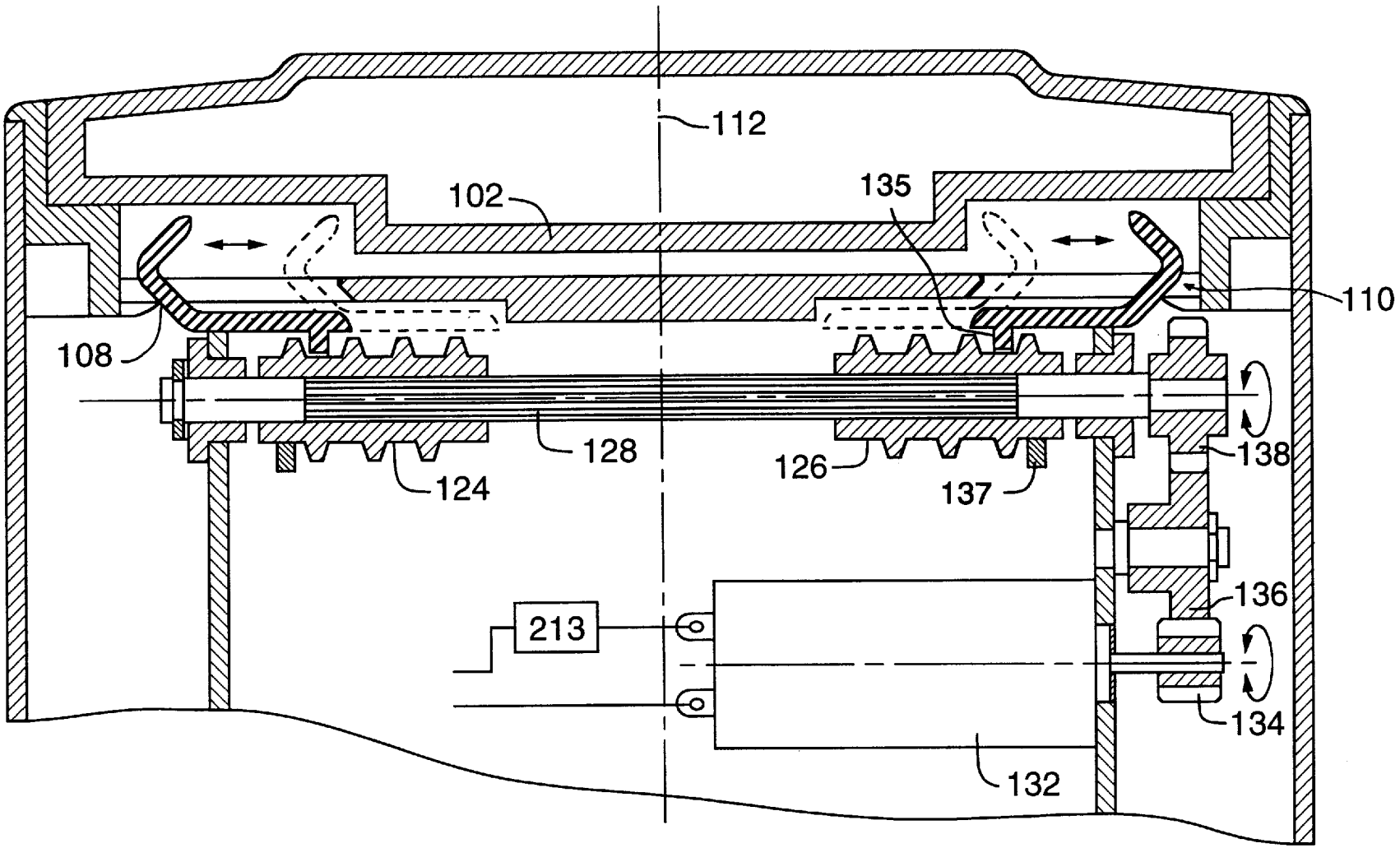
FIG. 8 is a sectional view along line F—F of FIG. 6.
Figure 9:
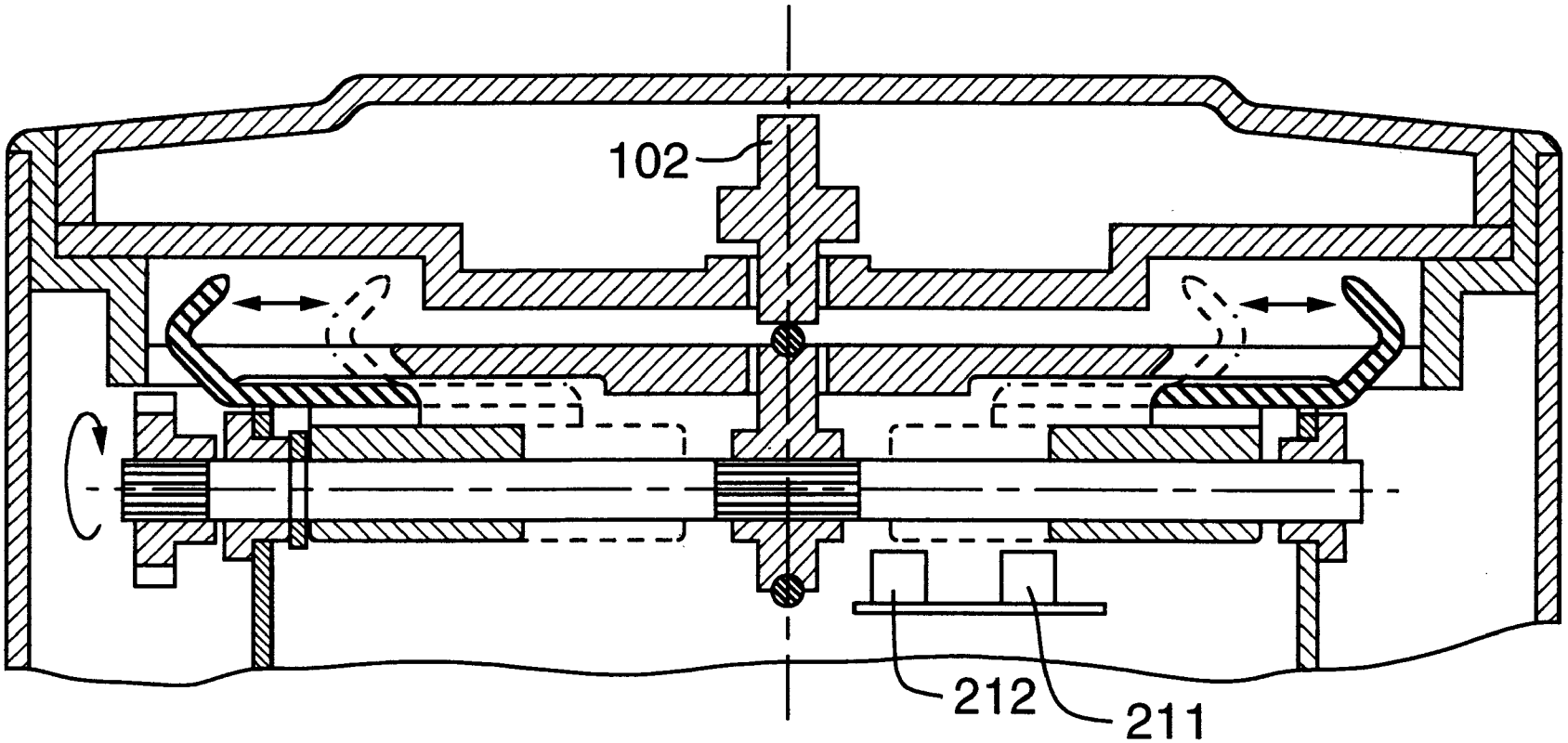
FIG. 9 is a sectional view along line G—G of FIG. 6.

As shown in FIG. 8, the V-shaped jaws 108 and 110 are movable inwardly such that the width of the path 102 is varied for centering a received banknote relative to the center line 112.

Figure 7:
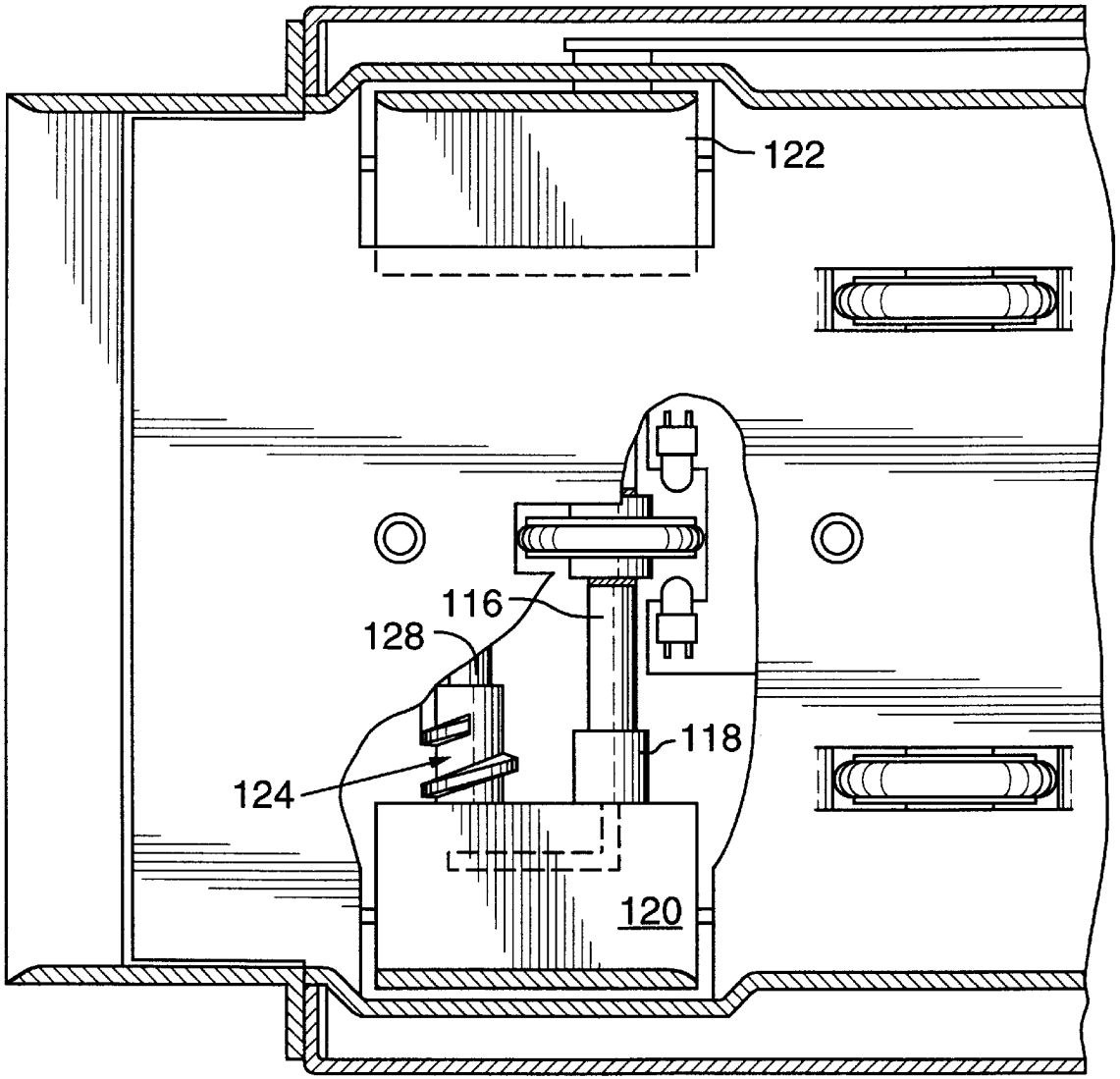
FIG. 7 is a sectional view along line E—E of FIG. 6.

As in the earlier structure, the V-shaped jaws 108 and 110 slide on shaft 116 as shown in FIG. 7. Basically, the bearing 118 merely slides along the shaft 116. At the center position, drive wheel 130 is splined to the shaft 116 and is fixed thereon. With this arrangement, shaft 116 can rotate causing drive wheel 130 to rotate while the shaft merely rotates in the bearing 118 of the side engaging members 120 and 122. The side engaging members 120 and 122 are driven by the screw thread drives 124 and 126 carried on shaft 128. The screw thread drives 124 and 126 are driven and cause the side engaging members 120 and 122 to either move outwardly or inwardly as shown by the doubled-sided arrow in FIG. 8. Shaft 116 includes a gear drive arrangement 149 connected to a motor drive (not shown). Therefore shaft 116 can be driven to rotate drive wheel 130 independently of the banknote centering drive.

With reference to FIG. 8, position sensors 211 and 212 sense the two end positions of the side engaging member. Sensor 213 measures the current draw of motor 132. With the jaws in the outer most position, the motor is switched on and a relatively high initial current draw occurs to start the motor and begin movement of the components. After start up, the current draw falls to a lower level until such time as the banknote is centered. When the banknote is centered, the stiffness of the bill supported in the slot opposes movement of the motor, as the side engaging members 120 and 122 cannot move further inwardly without buckling the supported bill. A centered bill is detected by a sudden increase in current draw as the motor stalls (movement of side members 120 and 122 opposed by bill). Sensor 214 detects this sudden increase in current draw and stops the motor. Once the banknote is advanced into the validator, i.e. it has cleared the centering device, the motor can be restarted to complete its cycle. Position sensors 212 and 213 confirm the end positions.

This current draw sensing arrangement requires adjustment from time to time to take into account changing conditions such as dirt and/or wear, which can change the average current draw required to center a banknote. In contrast, when the banknote is centered, the bill increases the forces on the centering mechanism which causes the current draw of the motor to increase. It is also important not to set too high a current draw, as buckling of the bill could occur. This changing condition over time is measured by cycling the centering mechanism from time to time without a banknote present. In this way, the average current can be measured and forms a base from which the increased current draw indicating a stalling condition can be measured. The validator senses when a cassette used to stack banknotes is removed and the insertion of a new cassette triggers the device to cycle the centering mechanism without a bill being present and to adjust the average current draw if necessary, or based on this test cycle.

Shaft 128 which drives the side member 120 and 122 has its own motor 132 and drive train. There is no requirement for a clutch to accommodate slippage when the side members have centered a banknote as a stall condition of the motor is sensed. The sensing arrangement 213 detects the increased correct draw due to the motor drive stalling and turns off the motor until the banknote clears the centering arrangement. Once a banknote clears the mechanism, the motor cycles the side members to move them to the wide or open position. The intermittent driving of a banknote through the centering mechanism allows more than sufficient time for centering and any locking of a banknote being moved by a side member is for a very short duration and can be distinguished from a final centered position.

FIG. 8 also shows the drive arrangement associated with electric motor 132. A first gear 134 is driven by the motor and is in drive relation gear 136 which rotates gear 138 causing rotation of shaft 128. With this rotation, the screw thread drives 124 and 126 rotate with shaft 128. Side engaging members 120 and 122 include lugs 134 and 136 which move along the screw drive members 124 and 126. This causes the desired movement of the side engaging members 120 and 122.

A separate motor 131 powers the fixed drive train associated with shaft 116. Rotation of gear 134 causes rotation of the non circular drive wheel 150. This non circular drive wheel includes three corner engaging portions 152, 154 and 156 distributed about the drive wheel. The drive wheel 150 includes non engaging portions 158 located between the engaging portions. The engaging portions drive the banknote towards the centered position 106, however, the amount of drive for each engaging portion is relatively small followed by a release space. This release space, i.e. surfaces 158, allow the side jaw members to progressively adjust the position of a banknote for centering. The wheel continues to move the banknote towards the centering position until it is sensed by sensor 160. During the process from the initial position at 104 to the center position at 106, the drive wheel is rotated a number of times and the banknote has been incrementally centered by the inward movement of the V-shaped jaws. The design is such that the V-shaped jaws move to their inner most position shown on dotted lines in FIG. 8 from their outer most position shown in FIG. 8. The movement of the jaws will cease when the banknote has been centered around center line 112 due to the sensing of a stall condition of motor 132.

A banknote is inserted by the user into the device at 104 for movement along the path 102. The user forces the bill by hand until it is sensed by sensor 162 and until the banknote generally strikes the drive wheel 150. At this point, the drive wheel starts its movement which causes the banknote to be advanced while also causing the side engaging members 120 and 122 to start to move inwardly driven by motor 132. The drive wheel alternatively drives and releases the banknote, allowing the banknote, during a release position, to move toward the centering position. By the time the banknote reaches the additional drive 200, the V-jaws have moved inwardly sufficiently to center a banknote, regardless of its width, and the banknote to the drive mechanism 200. The banknote can then be fed into a validator centered with the center line of the validator. This can be accomplished as the drive wheel will stop at a non engaging position. Once the banknote has cleared the centering device, the centering device will cause motor 132 to cycle and move the side engaging members outwardly until they reach their outermost position which is sensed by detector 211.

With the arrangement shown in FIGS. 6 through 9, a single motor and a relatively simple drive arrangement with a current sensing arrangement, is used to move a banknote from an insert position to a validator processing initial position, while also causing the side engaging members to move inwardly and center the banknote for processing. The drive arrangement has a unique drive wheel which causes an initial drive followed by a release, followed by a further drive, etc., and centering is accomplished during the release portion.

Although various preferred embodiments of the present invention have been described in detail, it will be understood by those skilled in the art, that variations may be made thereto without departing from the spirit of the invention or the scope of the appended claims.

The embodiments of the invention in which an exclusive property or privilege is claimed are defined as follows:

1. A banknote centering device comprising a slot for receiving banknotes of different widths longitudinally, side engaging members associated with said slot and movable from an open position either side of said slot to a narrow end position defining a minimum position between said side engaging members, a banknote drive mechanism for driving a banknote from an insert position to a centering position where the banknote is freely centered within said slot, a side drive arrangement for moving said side engaging members in a controlled manner towards one another and equally spaced either side of a centerline of said slot, said side drive arrangement including a clutch for controlled slippage of said side drive arrangement, said clutch set to slip when further inward movement of said side engaging members is opposed by a centered banknote engaging both side engaging members.

2. A banknote centering device as claimed in claim 1 wherein said side engaging members are slidable along a common shaft and said drive arrangement is positioned to one side of said shaft.

3. A banknote centering device as claimed in claim 2 wherein said side drive arrangement includes two screw drive members with one screw drive member in drive connection with one of said side engaging members and the other screw drive member in drive connection with the other side engaging member, said screw drive members being carried on and rotatable with a second shaft parallel to said common shaft, said screw drive members driving said paired side engaging members towards one another with rotation of said second shaft in one direction and driving said paired side engaging members away from each other with rotation of said second shaft in the opposite direction.

4. A banknote centering device as claimed in claim 1 wherein said banknote drive arrangement initially drives the banknote into the centering mechanism, then releases the banknote to allow centering, and then re-engages the bill for driving.

5. A banknote centering device as claimed in claim 4 wherein said drive mechanism includes a drive wheel of a non circular periphery which alternately engages the banknote for driving thereof and releases the banknote.

6. A banknote centering device as claimed in claim 5 wherein said drive mechanism includes an electric motor which powers said drive wheel and said electric motor forms part of and provides said power for side engaging drive arrangement.

7. A banknote centering device comprising a slot for receiving banknotes longitudinally where the banknotes are of varying widths, side engaging members associated with said slot and movable from an open position either side of said slot to a narrow end position defining a minimum position between said side engaging members, a drive mechanism for initially driving a banknote from an insert position to a centering position where the banknote will be centered within said slot in preparation for movement through a banknote validator and for moving said side engaging members in a controlled manner towards one another and equally spaced either side of a centerline, said drive arrangement including a clutch for controlled slippage of said side engaging members when further inward movement of said side engaging members is opposed by a centered banknote, said drive arrangement including a drive member which engages and releases said banknote when moved longitudinally from said insert position to said centering position with said side engaging members causing said banknote to move to a centered position when said banknote is released by said drive member.

8. A banknote centering device as claimed in claim 7 wherein said side engaging members and said drive member are driven by a common motor.

9. A banknote centering device as claimed in claim 8 wherein said drive member is a non circular drive wheel having drive engaging portions and drive release portions which alternate, said drive engaging portions driving said banknote and said drive release portions releasing said banknote.

10. A banknote centering device as claimed in claim 3 wherein said drive arrangement includes a fixed cycle reversible motor connected to said clutch with said clutch rotating said second shaft in a direction dependent upon the direction of rotation of said fixed cycle reversible motor.

11. A banknote centering device as claimed in claim 4 wherein said second shaft includes a drive wheel on a center portion of said second shaft which is in contact with a rotary drive member of said clutch which rotates about an axis perpendicular to the rotary axis of said second shaft.

* * * * *